US008915766B1

(12) United States Patent
Kolchin

(10) Patent No.: US 8,915,766 B1
(45) Date of Patent: Dec. 23, 2014

(54) AUTOMATIC KNIFE SHARPENER AND A METHOD FOR ITS USE

(71) Applicant: Dmitriy Kolchin, Orange, CA (US)

(72) Inventor: Dmitriy Kolchin, Orange, CA (US)

( * ) Notice: Subject to any disclaimer, the term of this patent is extended or adjusted under 35 U.S.C. 154(b) by 0 days.

(21) Appl. No.: 14/284,903

(22) Filed: May 22, 2014

(51) Int. Cl.
*B24B 49/10* (2006.01)
*B24B 49/12* (2006.01)
*B24B 3/54* (2006.01)

(52) U.S. Cl.
CPC . *B24B 3/54* (2013.01); *B24B 49/10* (2013.01); *B24B 49/12* (2013.01)
USPC ..... 451/5; 451/45

(58) Field of Classification Search
USPC ..... 451/5, 6, 8, 9, 10, 45, 260, 261, 263, 57
See application file for complete search history.

(56) References Cited

U.S. PATENT DOCUMENTS 4,176,396 A * 11/1979 Howatt ..... 702/34
4,843,767 A 7/1989 Johnson
5,793,493 A 8/1998 Lane
6,969,299 B1 11/2005 Papetti
2005/0072135 A1 4/2005 Kormann
2011/0281503 A1* 11/2011 Knecht et al. ..... 451/5

FOREIGN PATENT DOCUMENTS

WO 2007148878 A1 12/2007
WO 2009129157 A1 10/2009
WO 2012159149 A1 11/2012

* cited by examiner

*Primary Examiner* — Robert Rose
(74) *Attorney, Agent, or Firm* — Law Office of Ilya Libenzon

(57) ABSTRACT

A knife sharpener includes a knife holder in which a knife is inserted so that an edge of the knife is exposed, at least one edge sensor, configured to detect the edge of the knife, at least one abrader, the at least one abrader having a sharpening surface angled to meet an edge of the knife at a sharpening angle of one side of the knife, a motive mechanism connected to the holder and the at least one abrader, and a computing device in communication with the edge sensor and the motive mechanism, and configured to cause the at least one abrader to traverse the edge of the knife using the motive mechanism, in response to the at least one edge sensor. A method for knife sharpening involves directing the abrader to traverse the edge of the knife, responsive to input from an edge sensor.

18 Claims, 7 Drawing Sheets

AUTOMATIC KNIFE SHARPENER AND A METHOD FOR ITS USE

TECHNICAL FIELD

Embodiments disclosed herein relate generally to electronic knife sharpeners, and in particular to automated knife sharpening

BACKGROUND ART

Knives are perhaps the most ubiquitous simple tools in the world. Practically all households have a battery of kitchen knives for slicing and preparing food, jackknives or pen knives for various odd jobs, and utility knives for opening boxes and cutting twine. Hobbyists of various descriptions add a complement of hunting knives, skiving knives, knives for diving, fishing, camping, woodcarving, and various other recreational activities. Many mechanized labor-saving devices, such as food processors and lawnmowers, also contain edged components that can be classified as knives. Whatever a knife is used for, its utility generally depends on maintaining a keen edge. Dull kitchen knives, for instance, bruise the food they are intended to cut, and can slip and cause injury. Good steel and serration can hold friction at bay, but eventually every kind of knife must be sharpened, or replaced.

Sharpening with hand tools, however, can require more time and patience than many people are willing to invest. Power sharpeners have their own issues: if they are convenient they tend to produce a suboptimal edge, and if they are effective sharpeners they can also easily damage the knife blade, grinding it down or rounding its tip. Most automatic sharpeners also lack versatility when dealing with the various forms of knife blades that exist and need sharpening.

Therefore, there remains a need for an easy-to-use and efficient automated knife-sharpening system.

SUMMARY OF THE EMBODIMENTS

A knife sharpener is disclosed having a knife holder in which a knife is inserted so that an edge of the knife is exposed, at least one edge sensor, configured to detect the edge of the knife, at least one abrader, the at least one abrader having a sharpening surface angled to meet an edge of the knife at a sharpening angle of one side of the knife, a motive mechanism connected to the holder and the at least one abrader, and a computing device in communication with the edge sensor and motive mechanism, and configured to cause the at least one abrader to traverse the edge of the knife using the motive mechanism, in response to the at least one edge sensor. In an additional embodiment, the at least one edge sensor further includes a power source in electrical contact with the knife blade and with the at least one sharpening abrader, the power source further connected to a current sensor, such that contact between the blade and the at least one abrader modifies current flow through the current sensor. In an additional embodiment, the at least one edge sensor further includes a camera. In yet another embodiment, the at least one abrader further includes at least one coarse abrader and at least one fine abrader.

A method is also disclosed for sharpening a knife positioned in a holder of a knife sharpener as described above with an edge of the knife exposed, the method performed by a computing device incorporated in the knife sharpener. The method involves activating, by the computing device, the motive mechanism to bring a first abrader, of the at least one abrader, and the knife toward each other, receiving, by the computing device, from an edge sensor connected to the computing device, an indication that the first sharpening disc is in contact with the edge of the knife, and directing, by the computing device, the motive mechanism to cause the first abrader to traverse the edge of the knife.

In a related embodiment, activating further involves maintaining in memory accessible to the computing device a known orientation of the knife, maintaining in memory accessible to the computing device a known orientation of the first abrader, and directing the motive mechanism to move the first abrader and knife toward one another along a path between the knife and the first abrader. In another embodiment, directing further involves obtaining, by the computing device, at least one knife shape profile comprising an edge path, and directing the motive mechanism to cause the at least one abrader to traverse the edge path of the at least one knife shape profile. In a related embodiment, obtaining further involves capturing, with a sensor coupled to the computing device, an image of the knife and detecting, using an edge detection algorithm, the edge of the knife. In another related embodiment, obtaining further involves directing a contact sensor to traverse the edge of the knife, receiving edge location information from the contact sensor responsive to the traversal, and determining, responsive to the location information, the edge path. Another related embodiment further involves determining that the edge path does not follow the edge of the knife, correcting the edge path to follow the edge of the knife, and maintaining in memory accessible to the computing device, the corrected edge path.

In another embodiment, directing further involves receiving, from the edge sensor, an indication that the first abrader is no longer in contact with the edge of the knife, directing the motive mechanism to move the edge of the knife and the first abrader towards each other, receiving, from the edge sensor, an indication that the first abrader is in contact with the edge of the knife, and directing the motive mechanism to stop moving the edge of the knife and first abrader towards each other. In yet another embodiment, directing further involves receiving, from a contact edge sensor preceding the first abrader along the edge, an indication of a change in direction of the edge, and directing, by the computing device, the first abrader to change direction in response to the received indication. In still another embodiment, directing further includes determining, by the computing device, a sharpening angle of the knife and directing, by the computing device, the knife sharpener to adjust the angle of the first abrader with respect to the knife to match the determined sharpening angle. Another embodiment involves determining, by the computing device, a grind style of the knife and directing, by the computing device, the first abrader to grind the knife based on the determination. A related embodiment involves selecting, by the computing device, the first abrader from a plurality of abraders, based on the determination.

An additional embodiment involves detecting, by the computing device, a portion of the edge of the knife that lacks a burr, and directing, by the computing device, the motive mechanism to cause the first abrader to traverse the detected section of the edge of the knife. Another embodiment still involves, for each of one or more additional abraders, directing, by the computing device, the motive mechanism to bring the additional abrader and the edge of the knife into contact, receiving, by the computing device, from an edge sensor connected to the computing device, an indication that the additional abrader is in contact with the edge of the knife, and directing, by the computing device, the motive mechanism to cause the additional abrader to traverse the edge of the knife. Another embodiment involves determining, by the computing device, a degree of wear of the edge of the knife and selecting, by the computing device, the first abrader from a plurality of abraders, based upon the determination. In a related embodiment, determining further involves capturing, using a sensor, an image of the edge of the knife and identifying, by the computing device, a degree of wear in the captured image. In another related embodiment, determining further involves maintaining, in memory accessible to the computing device, a sharpening schedule for at least one knife, determining that the knife matches the at least one knife in the sharpening schedule, and retrieving from the sharpening schedule an expected degree of wear for the knife.

Other aspects, embodiments and features of the knife sharpener and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the knife sharpener and method shown where illustration is not necessary to allow those of ordinary skill in the art to understand the knife sharpener and method.

BRIEF DESCRIPTION OF THE DRAWINGS

The preceding summary, as well as the following detailed description of the disclosed knife sharpener and method, will be better understood when read in conjunction with the attached drawings. It should be understood, however, that neither the knife sharpener nor the method is limited to the precise arrangements and instrumentalities shown.

DETAILED DESCRIPTION OF SPECIFIC EMBODIMENTS

Figure 1:
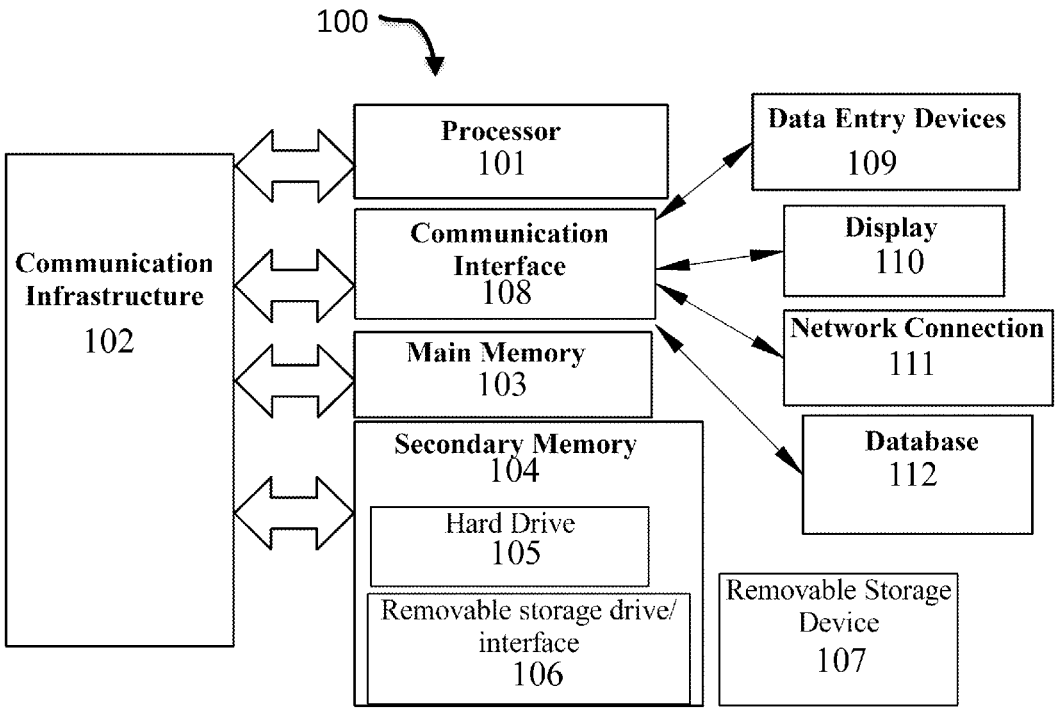
FIG. 1 is a schematic diagram depicting a computing device.

Some embodiments of the disclosed knife sharpener and method will be better understood by reference to the following comments concerning computing devices. A "computing device" may be defined as including personal computers, laptops, tablets, smart phones, and any other computing device capable of supporting an application as described herein. The system and method disclosed herein will be better understood in light of the following observations concerning the computing devices that support the disclosed application, and concerning the nature of web applications in general. An exemplary computing device is illustrated by FIG. 1. The processor 101 may be a special purpose or a general-purpose processor device. As will be appreciated by persons skilled in the relevant art, the processor 101 may also be a single processor in a multi-core/multiprocessor system, such system operating alone, or in a cluster of computing devices operating in a cluster or server farm. The processor 101 is connected to a communication infrastructure 102, for example, a bus, message queue, network, or multi-core message-passing scheme.

The computing device may also include a main memory 103, such as random access memory (RAM), and may also include a secondary memory 104. Secondary memory 104 may include, for example, a hard disk drive 105, a removable storage drive or interface 106, connected to a removable storage unit 107, or other similar means. As will be appreciated by persons skilled in the relevant art, a removable storage unit 107 includes a computer usable storage medium having stored therein computer software and/or data. Examples of additional means creating secondary memory 104 may include a program cartridge and cartridge interface (such as that found in video game devices), a removable memory chip (such as an EPROM, or PROM) and associated socket, and other removable storage units 107 and interfaces 106 which allow software and data to be transferred from the removable storage unit 107 to the computer system. In some embodiments, to "maintain" data in the memory of a computing device means to store that data in that memory in a form convenient for retrieval as required by the algorithm at issue, and to retrieve, update, or delete the data as needed.

The computing device may also include a communications interface 108. The communications interface 108 allows software and data to be transferred between the computing device and external devices. The communications interface 108 may include a modem, a network interface (such as an Ethernet card), a communications port, a PCMCIA slot and card, or other means to couple the computing device to external devices. Software and data transferred via the communications interface 108 may be in the form of signals, which may be electronic, electromagnetic, optical, or other signals capable of being received by the communications interface 108. These signals may be provided to the communications interface 108 via wire or cable, fiber optics, a phone line, a cellular phone link, and radio frequency link or other communications channels. Other devices may be coupled to the computing device 100 via the communications interface 108. In some embodiments, a device or component is "coupled" to a computing device 100 if it is so related to that device that the product or means and the device may be operated together as one machine. In particular, a piece of electronic equipment is coupled to a computing device if it is incorporated in the computing device (e.g. a built-in camera on a smart phone), attached to the device by wires capable of propagating signals between the equipment and the device (e.g. a mouse connected to a personal computer by means of a wire plugged into one of the computer's ports), tethered to the device by wireless technology that replaces the ability of wires to propagate signals (e.g. a wireless BLUETOOTH® headset for a mobile phone), or related to the computing device by shared membership in some network consisting of wireless and wired connections between multiple machines (e.g. a printer in an office that prints documents to computers belonging to that office, no matter where they are, so long as they and the printer can connect to the internet). A computing device 100 may be coupled to a second computing device (not shown); for instance, a server may be coupled to a client device, as described below in greater detail.

The communications interface in the system embodiments discussed herein facilitates the coupling of the computing device with data entry devices 109, the device's display 110, and network connections, whether wired or wireless 111. In some embodiments, "data entry devices" 109 are any equipment coupled to a computing device that may be used to enter data into that device. This definition includes, without limitation, keyboards, computer mice, touchscreens, digital cameras, digital video cameras, wireless antennas, Global Positioning System devices, audio input and output devices, gyroscopic orientation sensors, proximity sensors, compasses, scanners, specialized reading devices such as fingerprint or retinal scanners, and any hardware device capable of sensing electromagnetic radiation, electromagnetic fields, gravitational force, electromagnetic force, temperature, vibration, or pressure. A computing device's "manual data entry devices" is the set of all data entry devices coupled to the computing device that permit the user to enter data into the computing device using manual manipulation. Manual entry devices include without limitation keyboards, keypads, touchscreens, track-pads, computer mice, buttons, and other similar components. A computing device may also possess a navigation facility. The computing device's "navigation facility" may be any facility coupled to the computing device that enables the device accurately to calculate the device's location on the surface of the Earth. Navigation facilities can include a receiver configured to communicate with the Global Positioning System or with similar satellite networks, as well as any other system that mobile phones or other devices use to ascertain their location, for example by communicating with cell towers.

In some embodiments, a computing device's "display" 109 is a device coupled to the computing device, by means of which the computing device can display images. Display include without limitation monitors, screens, television devices, and projectors.

Computer programs (also called computer control logic) are stored in main memory 103 and/or secondary memory 104. Computer programs may also be received via the communications interface 108. Such computer programs, when executed, enable the processor device 101 to implement the system embodiments discussed below. Accordingly, such computer programs represent controllers of the system. Where embodiments are implemented using software, the software may be stored in a computer program product and loaded into the computing device using a removable storage drive or interface 106, a hard disk drive 105, or a communications interface 108.

The computing device may also store data in database 112 accessible to the device. A database 112 is any structured collection of data. As used herein, databases can include "NoSQL" data stores, which store data in a few key-value structures such as arrays for rapid retrieval using a known set of keys (e.g. array indices). Another possibility is a relational database, which can divide the data stored into fields representing useful categories of data. As a result, a stored data record can be quickly retrieved using any known portion of the data that has been stored in that record by searching within that known datum's category within the database 112, and can be accessed by more complex queries, using languages such as Structured Query Language, which retrieve data based on limiting values passed as parameters and relationships between the data being retrieved. More specialized queries, such as image matching queries, may also be used to search some databases. A database can be created in any digital memory.

Persons skilled in the relevant art will also be aware that while any computing device may include facilities to perform the functions of a processor 101, a communication infrastructure 102, at least a main memory 103, and usually a communications interface 108, not all devices will necessarily house these facilities separately. For instance, in some forms of computing devices as defined above, processing 101 and memory 103 could be distributed through the same hardware device, as in a neural net, and thus the communications infrastructure 102 could be a property of the configuration of that particular hardware device. Many devices do practice a physical division of tasks as set forth above, however, and practitioners skilled in the art will understand the conceptual separation of tasks as applicable even where physical components are merged.

Embodiments of the disclosed device and method provide a fast, efficient, and automatic system for sharpening knives. Some embodiments include the ability to correct errors in sharpening and to learn with repeated use. Automation allows a user to take advantage of high-efficiency mechanical abraders secure in the knowledge that the system's safeguards will prevent damage to the knives.

FIGS. 2A-2G depict a knife sharpener 200. As an overview, the knife sharpener includes a knife holder 201 in which a knife 202 is inserted so that an edge of the knife is exposed, at least one edge sensor 203, configured to detect the edge of the knife 202, at least one abrader 204, the at least one abrader 204 having a sharpening surface 205 angled to meet the edge of the knife 202 at an angle matching a sharpening angle of one side of the knife 202, a motive mechanism 206 connected to the holder 201 and the at least one abrader 204, and a computing device 207 in communication with the edge sensor 203 and motive mechanism 206, and configured to cause the at least one abrader 204 to traverse the edge of the knife 202 using the motive mechanism 206, in response to the at least one edge sensor 203.

Referring to FIGS. 2A-2F in more detail, the system 200 includes a knife holder 201 in which a knife 202 is inserted so that the edge of the knife is exposed. The knife holder 201 may be set on a mechanized structure, such as a motorized joint, that allows the angle of the knife 202 held in the holder 201 to be adjusted with respect to the at least one abrader 204, as set forth in further detail below. When in the holder 201, the knife 202 may be oriented in any direction that leaves its edge exposed. The knife 202 may be held with its edge upward. The knife 202 may be held with its edge downward. In some embodiments, the knife 202 is held with its edge to one side. In some embodiments, the knife holder 201 is a platform with at least one groove. The at least one groove may be formed to accept a typical knife with the non-sharpened side inserted in the groove, so that the sharpened edge of the knife is facing upwards. The at least one groove may be formed to fit the knife 202 snugly, so that when a knife is inserted in the at least one groove, the knife is held in a substantially immobile manner; for instance, the at least one groove may fit the knife snugly enough to keep the knife substantially immobile during the application of the at least one abrader 204, as set forth in more detail below. The at least one groove may have an elastic lining that deforms on insertion of the knife 202 and subsequently exerts a recoil force against the sides of the knife 202, to hold the knife 202 securely in place. The elastic lining may be formed so that the groove can accept knives of varying widths and lengths and hold them securely. The elastic lining may be composed at least in part of an elastic polymer such as rubber. The elastic lining may be composed at least in part of one or more springs. The at least one groove may be a plurality of grooves. The plurality of grooves may have varying lengths, to accept knives of varying lengths. The plurality of grooves may have varying depths, to accept knives of varying widths. The plurality of grooves may have varying widths, to accept knives of varying thicknesses. In some embodiments, the at least one groove has a width that varies over the length of the at least one groove, to accommodate variation in the thickness of the knife 202. For instance, a first portion of the at least one groove may be narrow to accommodate a knife blade, and a second portion of the at least one groove may be broader to accommodate a knife handle. The portion that accommodates the handle may be formed to hold the handle securely. In other embodiments, the portion that accommodates the handle is roomier, to accommodate a wider range of handles. In some embodiments, the at least one groove contains an electrically conducting pathway connecting the blade of the knife to a power source and current sensor, as set forth in more detail below.

In some embodiments, the holder 201 includes at least one clamp. In an embodiment, the at least one clamp has at least two substantially opposing surfaces arranged to grip the knife 202 between them, and at least one clamping element forcing the at least two surfaces together to exert pressure on the knife 202, to hold it firmly in place. The at least two opposing surfaces may include a side of a groove as described above. The at least two opposing surfaces may include a movable block; for instance, the clamp may use the side of one groove as one surface, and a movable block as another. The at least one clamp may grip the knife 202 between two movable blocks. The at least two surfaces may be the gripping surfaces of a pincher, such as a robot claw or a pair of pliers. The at least one clamping element may include a biasing means; for instance, the at least one clamping element may include a spring. The at least one clamping element may include a weight. In some embodiments, the at least one clamping element includes a magnet; the magnet may be a permanent magnet. The magnet may be an electromagnet. In some embodiments, the gripping force of the electromagnet may be variable. The electromagnet may be controlled by the computing device 207.

In other embodiments, the clamping element includes at least one screw. Rotation of the screw may cause the clamping surfaces to draw together by rotation; for example, a member attached to one of the clamping surfaces may have a bearing on which the screw is journaled, and a member attached to one of the other clamping surfaces may have a threaded nut, such that rotation of the screw within the bearing and threaded nut causes the members to move toward or away from each other, which in turn causes the surfaces to move toward or away from each other. The screw may be driven by manual adjustment; for instance, the screw may be attached to a crank that may be turned manually. The screw may be driven by a motor, such as an electric, pneumatic, or hydraulic motor; the motor may be controlled by the computing device 207. The clamping element may include at least one ratchet. The ratchet may be manually driven. The ratchet may be driven by a motor controlled by the computing device 207. Embodiments of the clamp may include the structural element of any clamp that accomplishes the above-describe goals, including without limitation, bar clamps, F-clamps, sliding clamps, bench clamps, Cardellini clamps, C-clamps, handscrew clamps, Kant-twist clamps, magnetic clamps, pipe clamps, sash clamps, speed clamps, toggle clamps, toolmakers' clamps, locking pliers, and any form of robotic hand that can perform a clamping action as described above.

The knife 202 to be sharpened in the knife sharpener may be any form of knife amenable to sharpening. The knife 202 may be formed of any material or combination of materials that may be sharpened. In some embodiments, the knife 202 is formed at least in part of metal. The metal may include alloy steel. The metal may include one or more tool steels. The metal may include chrome steel. The metal may include semi-stainless steels. The metal may include stainless steel. The metal may include hi-speed steel. The metal may include stain-proof steels. The metal may include carbon steel. The metal may include Damascus steel. The metal may include talonite. The metal may include stellite. The metal may include tungsten carbide. The metal may include titanium. The knife 202 may be composed at least in part of iron. The knife 202 may be composed at least in part of another metal such as bronze. In some embodiments, the knife 202 includes one or more alloying elements, including, without limitation, carbon, chromium, cobalt, copper, manganese, molybdenum, nickel, niobium, nitrogen, phosphorus, silicon, sulfur, tungsten, and vanadium. In other embodiments, the knife 202 is composed at least in part of metal glass, such as $Ti_{40}Cu_{36}Pd_{14}Zr_{10}$. In other embodiments, the knife 202 is composed at least in part of a ceramic. The ceramic may include aluminum oxide ceramic (Al2O3). The ceramic may include zirconium dioxide (ZrO2). The knife 202 may be composed at least in part of a polymer. The polymer may be plastic. The plastic may be polycarbonate. The knife 202 may be composed at least in part of a crystalline material, such as sapphire. The knife may have any blade profile, including without limitation a normal profile, a tanto profile, a chisel-point profile, a drop-point profile, a clip-point profile, a trailing-point profile, a sheep's foot profile, a spey-point profile, a Wharncliffe profile, a leaf blade profile, a spear-point profile, a needle-point profile, a hawkbill profile, an Ulu or Tumi profile, a Kris recurving profile. The knife 202 may be single-edged. The knife 202 may have two or more edges; for instance, the knife 202 may have a double-edged dagger blade. The knife 202 may have a more complex blade such as a Shaolin hook sword or a multi-bladed throwing knife such as a shuriken or a Central African throwing knife. The edge of the knife 202 may be serrated. The edge of the knife 202 may be straight. The knife may have any grind suitable for producing a sharp edge. The knife 202 may be flat-ground. The knife 202 may be hollow-ground. The knife 202 may be saber-ground. The knife 202 may be double-bevel ground. The knife 202 may be convex ground. The knife 202 may be chisel-ground. The knife 202 may have any combination of grinds; for instance, the knife 202 may have a single bevel as in a chisel grind, with a concave grind consistent with a hollow-ground knife. A portion of the knife may be serrated while another portion is saber-ground.

The knife sharpener 200 includes at least one edge sensor 203, configured to detect the edge of the knife 202. In one embodiment, the at least one edge sensor 203 is at least one device that enables the computing device 207 to determine the location of at least one point that is on the edge of the knife. In some embodiments, as depicted in the circuit diagram in FIG. 2G, the at least one edge sensor 203 includes a power source 208 in electrical contact with the blade of the knife 202 and with the at least one abrader 204, the power source further connected a current sensor 209, such that contact between the blade and the at least one abrader 204 modifies current flow through the current sensor 209; the computing device 207 may combine the input of the current sensor 209 with a known location or orientation of the knife blade to determine whether the at least one abrader 204 is in contact with the edge of the knife 202. In some embodiments, contact between the blade and the at least one abrader 204 closes a circuit containing the power source 208 and the current sensor 209, so that the current sensor detects a new current through the circuit. In other embodiments, the at least one edge sensor 203 includes a camera. The edge sensor 203 may further include a light source (not shown). The light source may be a flash. The light source may be an incandescent light bulb. The light source may be a florescent light bulb, such as a compact florescent light. The light source may be a light-emitting diode (LED). The light source may be bioluminescent. The light source may be phosphorescent. The light source may be chemiluminescent. The light source may be radioluminescent. The light source may be a device that transmits exterior light to the camera's field of vision by reflective means.

In other embodiments, the edge sensor 203 includes a linear displacement sensor. The edge sensor 203 may include a capacitive sensor. The edge sensor 203 may include an inductive sensor. The edge sensor 203 may include one or more tactile switches. The edge sensor 203 may include a rotary position sensor. The edge sensor 203 may include one or more linear voltage differential transformers. The edge sensor 203 may include a magnetostrictive linear position sensor. The edge sensor 203 may include an eddy current-based position sensor. The edge sensor 203 may include a Hall effect based magnetic position sensor. The edge sensor 203 may include a fiber-optic position sensor. The edge sensor may include an optical position sensor. The edge sensor 203 may include a laser profile sensor. The edge sensor 203 may include an inductive metal proximity sensor. The edge sensor 203 may include an LED displacement sensor. In some embodiments, the edge sensor 203 has the ability to determine the length of the knife-edge, as set forth in more detail below. In some embodiments, the at least one edge sensor 203 includes more than one sensor; for instance, the knife sharpener 200 may use a camera to find the edge of the knife 202 and a current sensor 209 as described above to detect contact with the edge of the knife 202. In another embodiment, the at least one edge sensor 203 may include two contact sensors arrayed in series such that the detection by one of the sensors of a change in direction of the edge of the knife 202 can trigger an alternation in the path the at least one abrader 204 takes to follow the edge of the knife 202, as described in more detail below. The at least one abrader 204 may be placed between the two sensors.

The knife sharpener 200 includes at least one abrader 204, the at least one abrader 204 having a sharpening surface 205 angled to meet the edge of the knife 202 at an angle matching a sharpening angle of one side of the knife 202. The abrader 204 is a component that when traversing the edge of the knife abrades the adjacent surface, such that if angled correctly, it sharpens the edge of the knife 202. In some embodiments, the abrader is a static surface, such that the sole source of motion causing friction between the abrader 204 and the knife 202 is the motion induced by the motive mechanism 206. In other embodiments, the abrader is an active abrader, in that it possesses motive element of its own to cause friction between the knife 202 and the sharpening surface 205 independently of the motion induced by the motive mechanism 206. The active abrader 204 may include at least one sharpening disc, in which the sharpening surface 205 is the face of the disc and the disc rotates about an axis through the center of its face. The active abrader 204 may be include a sharpening wheel, in which the sharpening surface 205 is the rim of the wheel, such as in a traditional grindstone; the sharpening wheel may have a curved edge profile for insertion between serrations. The sharpening wheel may be an elongated cylinder. The active abrader 204 may include a sharpening belt, in which the sharpening surface 205 is at least one side of the belt, and that side of the belt is caused to move past the edge of the knife 202 by a motive mechanism such as a set of rotating shafts around which the belt is wound. The active abrader 204 may include a sonic sharpener, which functions by causing an abrasive surface to vibrate against the edge of the knife 202. The active abrader 204 may include one or more sharpening blades.

Where the at last one abrader 204 includes an active abrader, the at least one abrader 204 may include at least one motor. In some embodiments, the at least one motor is at least one electric motor. The at least one electric motor may be any device that converts electrical energy into rotational kinetic energy. The at least one motor may be a brushed direct current motor. The at least one electric motor may be a brushless motor. The at least one electric motor may be a permanent-magnet synchronous motor. The at least one electric motor may be a permanent magnet motor. The at least one electric motor may be a reluctance-based motor, such as a switched reluctance motor, an induction motor, or an asynchronous induction motor. The at least one electric motor may be a stepper motor. The at least one electric motor may be a servomotor. In some embodiments, the at least one electric motor includes one or more elements to convert direct current to alternating current. The elements may include an inverter. The elements may include a switching power supply.

In some embodiments, the at least one motor may include a pneumatic motor; for instance, the at least one motor may be a pneumatic rotary motor. The at least one motor may include a hydraulic motor. In some embodiments, each abrader 204 is driven by separate motor. For instance, where the at least one abrader 204 includes a set of sharpening discs or wheels, each sharpening disc or wheel may be mounted on the shaft of a separate motor. Several sharpening discs or wheels may be mounted together on a single shaft. Likewise, a single set of rollers may drive several belts in parallel. In other embodiments, a plurality of abraders is driven by a single motor; for instance, a motor may connect to a gearbox in which each abrader is driven by a rotary shaft driven by the motor via the gearbox.

The at least one sharpening surface 205 may be composed in part of an abrasive material. The sharpening surface 205 may comprise any natural or synthetic material or combinations of abrasive materials. For example the sharpening surface 205 may comprise a bonded abrasive composed of fine particles of a hard material. The hard material may include silicon carbide (carborundum). The hard material may include aluminium oxide (corundum). The hard material may include diamond grit. The hard material may include chrome or chromium oxide (CrO). The hard material may include silicon dioxide (Novaculite). The hard material may include ferric oxide. The hard material may include steel. Abrasives used in sheets or grinding wheels may be synthetic materials produced via a process that makes the crystals from a combination of the above-described elements. The sharpening surface 205 may be made in part of natural stone. The sharpening surface 205 may be made in part of ceramic. The sharpening surface 205 may be metal with a ridged or toothed surface, such as the surface of a metal file or a honing steel. In some embodiments, the at least one abrader 205 further includes at least one coarse abrader and at least one fine abrader. For instance, at least one abrader 205 may include at least one sharpening surface 205 designed for the grinding stage of sharpening, and a second sharpening surface 205 designed for the honing or polishing stage of sharpening. In other embodiments, the at least one abrader 204 includes at least one honing surface, such as a smooth or vertically grooved steel, for straightening out rolled portions of the edge of the knife 204. In additional embodiments, the at least one abrader 204 includes at least one stropping surface, such as a strip of stropping leather or a stropping disc, for finely finishing the edge of the knife 204. In some embodiments, the coarse abrader 204 has an International Standards Organization/Federation of European Producers of Abrasives (ISO/FEPA) grit coarser than P500, medium coarse abraders 204 have an ISO/FEPA grit in the range of P600-P1500, and fine abraders 204 have an ISO/FEPA grit of P1500 or finer.

The sharpening surface 205 of the abrader 204 is angled to meet the edge of the knife 202 at an angle matching the sharpening angle of one side of the knife 204. In some embodiments, the sharpening surface 205 of the abrader 204 is fixed at an angle with respect to a knife 202 held in the holder 201 that matches the sharpening angle of one side of a typical knife. In other embodiments, the angle of the sharpening surface 205 with respect to a knife 202 held in the holder 201 is adjustable. The structure on which the abrader 204 is positioned may include a mechanism that permits it to pivot the abrader 204 to adjust the angle of the surface 205. In other embodiments, the angle at which the holder 201 holds the knife 202 is adjustable, as described above in reference to FIG. 2. In some embodiments, where the sharpening surface 205 is curved, the angle of the surface is defined as the angle of a plane tangent to the curvature of the sharpening surface 205. In some embodiments, where the abrader 204 is a sharpening disc, the abrader 204 is angled with respect to the edge of the knife 202, such that the face of the disc contacts the knife only in one direction of rotation. For instance, the sharpening disc may be positioned at an angle of approximately 3 degrees with respect to a line tangent to the edge of the knife 202; in some embodiments, the angle of the at least one sharpening disc is such that the disc always grinds the knife in the same direction with respect to the edge of the knife 202. In some embodiments, the at least one abrader 204 has at least one sharpening surface 205 for each side of the knife 202. For instance, where the knife 202 has a sharpening angle on each side, as in a saber or flat-ground knife, the at least one abrader 204 may have at least one sharpening surface 205 angled to sharpen the knife 202 along the sharpening angle of the first side, and at least one sharpening surface 205 angled to sharpen the knife 202 along the sharpening angle of the second side. In additional embodiments, the at least one abrader 204 has at least one sharpening surface 205 that may be rotated to match the sharpening angle on both sides of the edge of the knife 202. In some embodiments, such as a sharpening wheel or a belt on a triangular array of rollers, the same sharpening surface 205 may present a plurality of angles depending on which part of the sharpening surface 205 contacts the knife 202. As an example, adjusting the angle of a wheel abrader 205 as described above in reference to FIG. 2 can be accomplished solely by choosing where on the circumference of the wheel the knife 202 will make contact.

The knife sharpener 200 includes a motive mechanism 206 connected to the holder 201 and the at least one abrader 204. In some embodiments, the motive mechanism 206 is a machine, such as a computer numerical control (CNC) machine, designed to move a head with respect to a platform, as instructed by the computing device 207. The platform may be a table. In some embodiments, the platform is movable with respect to the overall machine. As an example, the platform may have at least one slider along which it may be moved along a horizontal axis; for instance, the platform may have sliders along which it can travel in two horizontal directions spanning the horizontal plane, such as the x and y axes denoted in FIG. 2A, allowing it to be moved according to Cartesian coordinates. The platform may include at mechanism to propel it along the at least one slider in response to a signal from the computing device 207. In another embodiment, the platform includes a rotational mechanism analogous to a potter's wheel allowing it to be rotated in the horizontal plane; the rotational mechanism may combine with at least one slider to allow the platform to be moved according to polar coordinates, or in response to rotational transformations. The platform may include an elevator mechanism allowing it to be moved vertically, for instance, along the z-axis denoted in FIG. 2A. The platform may include a means to change its pitch with respect to the horizontal plane; for instance, the platform may be able to incline itself to change the angle of the knife 202 with respect to the at least one abrader 204. In some embodiments, the platform may be able to change the angle of the knife in more than one direction; for instance, the platform may be able to angle the knife with respect to a sharpening disc to place the sharpening disc at the correct sharpening angle with respect to the knife and to ensure that the sharpening disc always abrades the knife in the same direction, as set forth above in reference to FIGS. 2A-2E. Thus, in some embodiments, the motive mechanisms of the platform perform all of the actions necessary for the motive mechanism, including setting the angle of the knife 202 with respect to the at least one abrader 204. The platform may include one or more components bound to the table; for instance, the platform may have a clamp, as described above in reference to FIGS. 2A-2F, that holds the knife 202 in the position necessary for the at least one abrader 204 to sharpen it correctly. In other embodiments, the at least one abrader 204 is mounted on the platform.

In some embodiments, the motive mechanism includes one or more mechanisms to move the head. The head may be moved along one or more sliders as described above with regard to the platform. The head may have one or more elements moving it in a rotary manner as described above regarding the platform. The head may have an elevator mechanism for moving it vertically, as described above regarding the platform. In some embodiments, the head is mounted on a robot arm; for instance, the head may be mounted on a series of jointed sections, wherein each joint has a mechanism that causes the joint to flex in response to commands from the computing device 207. As an example, a hydraulic piston may connect to sections on either side of the joint, so that extending the piston causes the joint to straighten, and retracting the piston causes the joint to flex, or in other words decreases the smaller angle between the two sections. The joints may be driven by other mechanisms such as cable tension, pneumatic piston, and in joint motor mechanisms, as well. In some embodiments, the at least one abrader 204 is mounted on the head of the motive mechanism, and the holder is mounted on the platform. Persons skilled in the art will recognize that above-described elements of the motive mechanism 206 may be combined in a number of different ways. Furthermore, the motive mechanism 206 may be designed in conformance with the above description with varying degrees of scale. For example, a motive mechanism as described above can be compactly designed so that its range of motion is restricted to a region small enough to encompass a knife 202 of a certain size; the machine may, for instance, be just large enough to accommodate a large kitchen knife while allowing the motive mechanism 206 sufficient freedom to move the at least one abrader 204 about the knife 202 and cause it to traverse the edge of the knife as set forth in greater detail below. As another example, the entire device may be a box in which the holder 201 is a slot into which the edge of the knife 202 is placed, with the motive mechanism 206 and at least one abrader 204 contained within the box such that the abraders traverse the knife edge within the box when the knife is placed in the slot. Likewise, the computing device 207 may be a small special-purpose device designed for compactness. The motive mechanism 206 may use any motor or combination of motors described above in reference to FIGS. 2A-2E as suitable for the at least one abrader 204.

The knife sharpener 200 includes a computing device 207 in communication with the edge sensor 203 and motive mechanism 206, and configured to cause the at least one abrader 204 to traverse the edge of the knife 202 using the motive mechanism 206, in response to the at least one edge sensor 203. In some embodiments, the computing device 207 is a computing device 100 as described above in reference to FIG. 1. The computing device 207 may be a special-purpose device, such as a microprocessor embedded in the knife sharpener 200. The computing device 207 may be a general-purpose device in communication with the knife sharpener 200. In other embodiments, the computing device 207 is a set of computing devices 100, as discussed above in reference to FIG. 1, working in concert; for example, the computing device 201 may be a set of computing devices in a parallel computing arrangement. In some embodiments, the computing device 207 is coupled to a database 112 as described above in reference to FIG. 1.

In some embodiments, the knife sharpener 200 includes an accelerometer to detect excessive vibration. The knife sharpener 200 may include at least one thermometer; for instance, the at least one thermometer ma measure the temperature of the knife 202 during sharpening, and signal to the computing device that the temperature is reaching a threshold, such as the point at which the temperature could harm the temper at the edge of the knife 202. In some embodiments, the knife sharpener 200 includes a sensor, such as a microphone, to measure the degree of vibration in the knife 202 or the sharpener 200; for instance, the computing device 207 could have a threshold level of vibration, such as a level above which the sharpener 200 or knife 202 could experience damage or an unacceptable rate of wear. Some embodiments of the knife sharpener 200 include a vacuum to clean up filings from the sharpening process. Other embodiments of the knife sharpener 200 include a magnet to clean up filings from the sharpening process; the magnet may be an electromagnet. Some embodiments of the knife sharpener 200 include a heat compensation system. The heat compensation system may include an air-cooling device; for instance, one or more fans may blow air on the knife 202 or at least one abrader 204 to reduce their temperature; the one or more fans may be controlled by the computing device 207. The heat compensation system may include a liquid-cooling device; for instance, there may be one or more sprayers that spray liquid on the knife or sharpeners as directed by the computing device 207. There may be one or more tubes in thermal contact with the knife 202 or a portion of the sharpener 200 to transport heat away. In some embodiments, the heat compensation system includes a heat sink, such as a relatively massive heat-conducting object in thermal contact with the knife 202 or sharpener 200 to absorb heat; in some embodiments, the heat sink is connected to further cooling systems as described above, or to another heat dissipater such as fins. In some embodiments, the knife sharpener 200 includes one or more vibration compensation devices.

In some embodiments, the knife sharpener 200 includes one or more elements for noise reduction. The knife sharpener 200 may employ passive noise reduction elements. The knife sharpener 200 may have a base (not shown) constructed to reduce the transmission of vibrations to a surface on which the knife sharpener 200 rests while in operation; for instance, the base may include a layer made of an elastic polymer, such as rubber, to absorb vibrations. The base may include a layer of porous acoustically absorbent material, such as a textile, a textile felt, an open-cell foam, bitumen blanket material, or cotton blanket material. The knife sharpener 200 may have a case (not shown) that encloses substantially all of the knife sharpener. The case may include any porous acoustically absorbent material as described above. In some embodiments, the knife sharpener 200 employs active noise cancellation techniques. As an example, the knife sharpener 200 may include a microphone (not shown) that records noises being produced by the knife sharpener, and a noise cancellation device (not shown) that inverts the recorded noise and outputs the inverted noise through a speaker, canceling the recorded noise. The computing device 207 may perform the inversion.

Figure 2A:
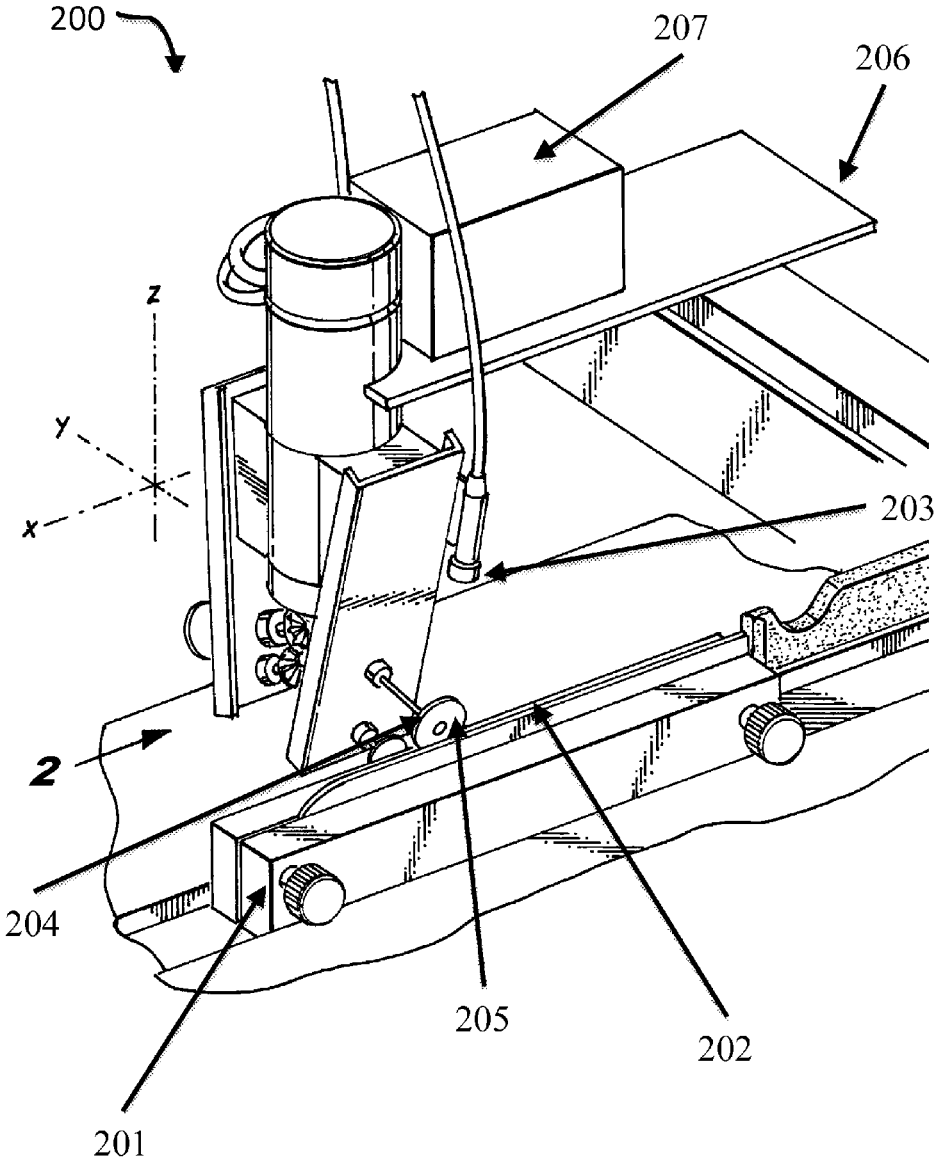
FIG. 2A is a schematic diagram depicting an embodiment of the disclosed system.
Figure 2B:
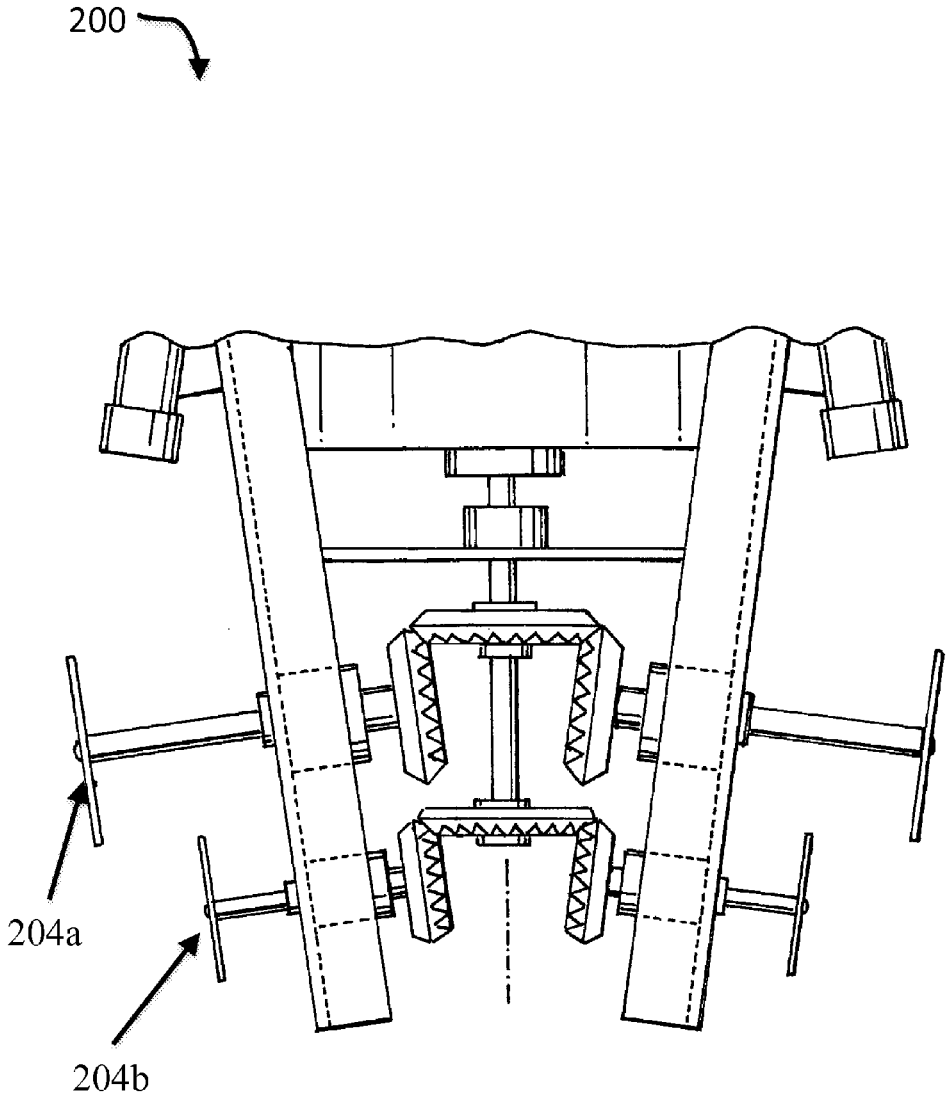
FIG. 2B is a schematic diagram depicting a detail of an embodiment of the disclosed system.
Figure 2C:
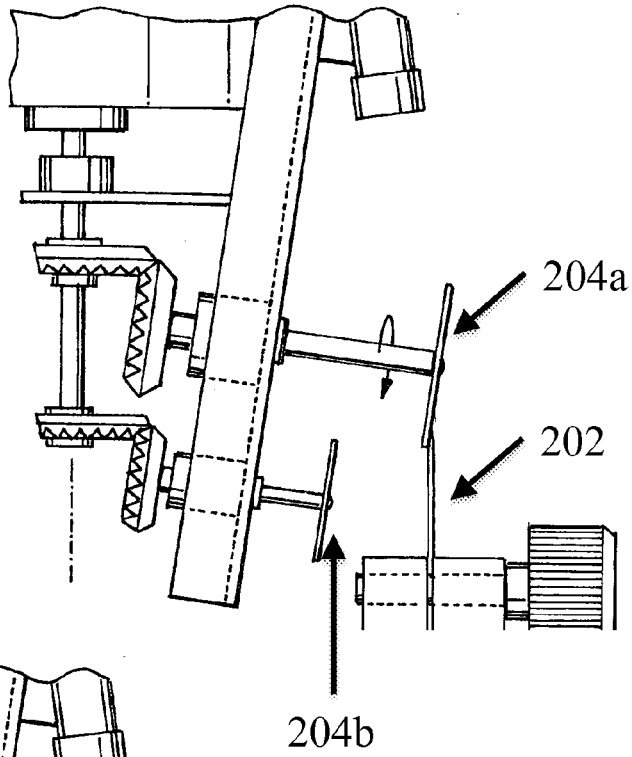
FIG. 2C is a schematic diagram depicting a detail of an embodiment of the disclosed system.
Figure 2D:
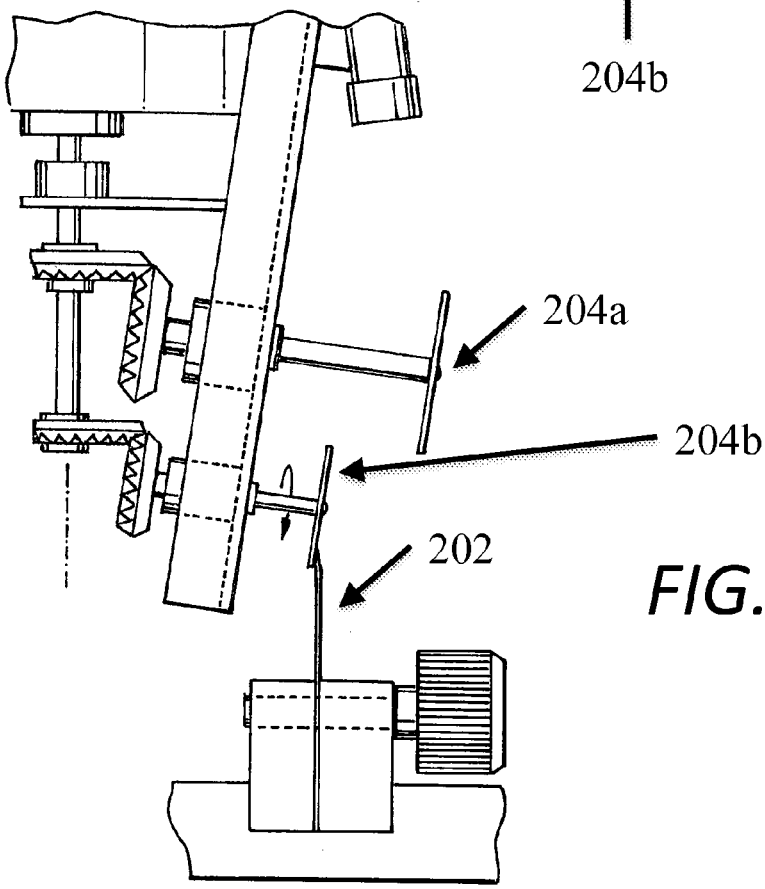
FIG. 2D is a schematic diagram depicting a detail of an embodiment of the disclosed system.
Figure 2E:
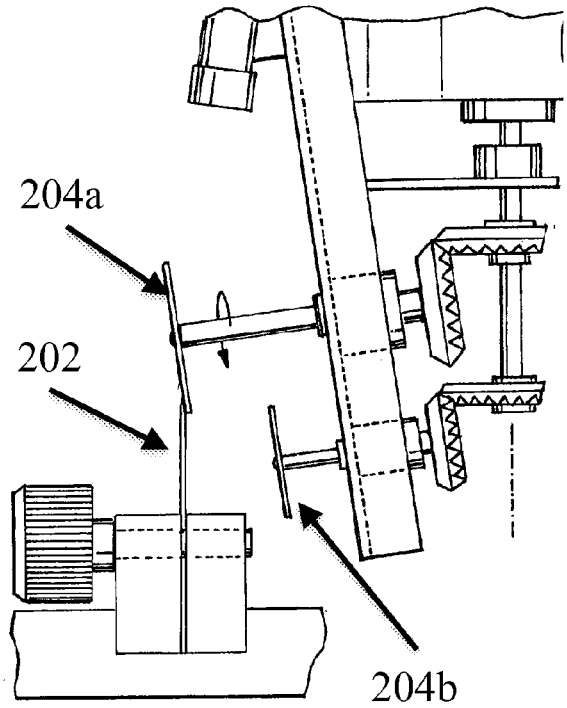
FIG. 2E is a schematic diagram depicting a detail of an embodiment of the disclosed system.
Figure 2F:
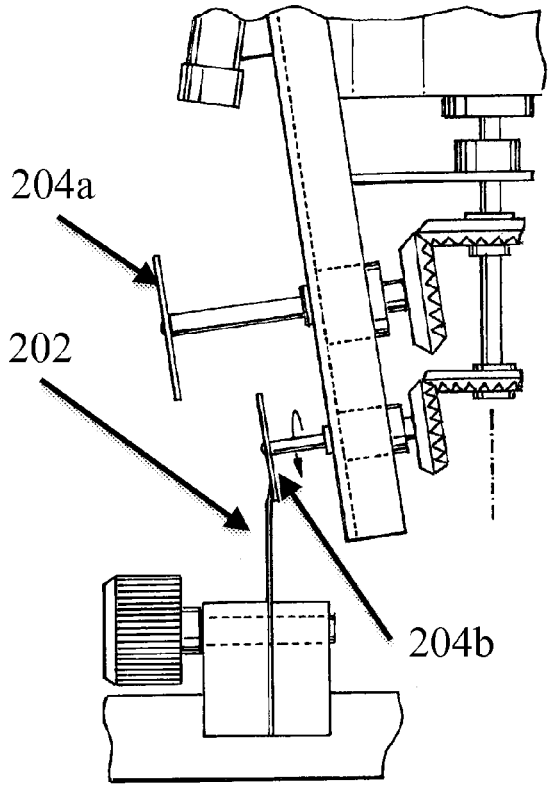
FIG. 2F is a schematic diagram depicting a detail of an embodiment of the disclosed system.
Figure 2G:
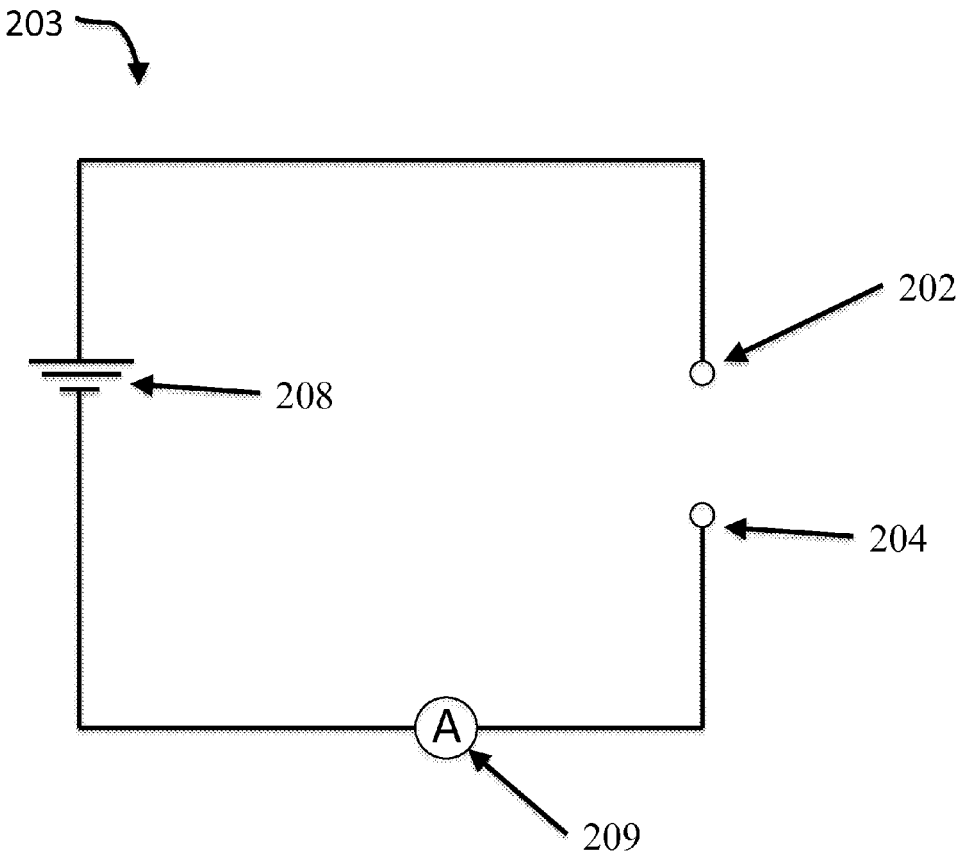
FIG. 2G is a circuit diagram depicting a detail of an embodiment of the disclosed system.
Figure 3:
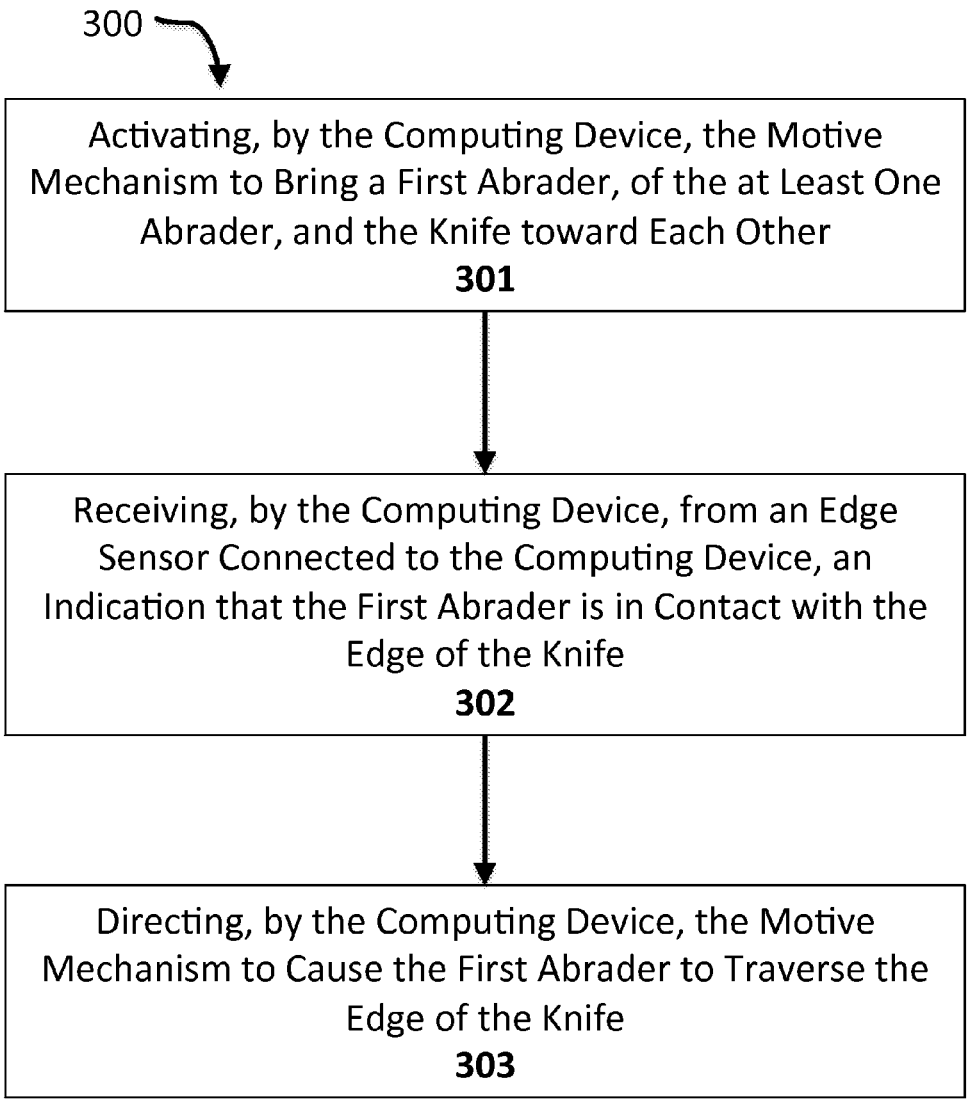
FIG. 3 is a flow chart illustrating one embodiment of the disclosed method.

FIG. 3 illustrates one embodiment of a method 300 for sharpening a knife positioned in a holder with the edge of the knife exposed, the method performed by a computing device incorporated in a knife sharpening mechanism as described above in reference to FIG. 2A-2G. The method 300 includes activating, by the computing device, the motive mechanism to bring a first abrader and the knife toward each other (301). The method includes receiving, by the computing device, from an edge sensor connected to the computing device, an indication that the first abrader is in contact with the edge of the knife (302). The method 300 includes directing, by the computing device, the motive mechanism to cause the first abrader to traverse the edge of the knife (303).

Referring to FIG. 3 in greater detail, and by reference to FIG. 2, the method 300 includes activating, by the computing device, the motive mechanism to bring a first abrader and the knife toward each other (301). In some embodiments, computing device 207 maintains a known orientation of the knife 202 in memory accessible to the computing device 207, maintains in memory accessible to the computing device 207 a known orientation of the first abrader 204, and directing the motive mechanism to move the first abrader and knife toward one another along a path between the knife and the at least one abrader. As an example, where the knife holder is on the platform of a CNC machine such that the knife 202 is oriented within the holder with its edge vertically upward, and the first abrader 204 is located on the head of the CNC machine, the computing device 207 may direct the CNC machine to start the head with the first abrader 204 positioned directly above where the knife edge is likely to be given the known position of the holder; the computing device 207 may then direct the CNC machine to lower the first abrader 204 until it is in contact with the knife edge.

In another embodiment, activating includes capturing, with a sensor coupled to the computing device 207, an image of the knife 202, detecting, using an edge detection algorithm, the edge of the knife 202, determining a location of the edge of the knife in three-dimensional space based upon the detection, and directing the motive mechanism to bring the first abrader 204 and the edge of the knife 202 together, based upon the determination. The sensor may be a camera. The sensor may be a profile sensor such as a laser profile sensor. The edge detection algorithm may be a search-based edge detection algorithm. The edge detection algorithm may be a zero-crossing based edge detection algorithm. The computing device 207 may map the pixels of the captured image to a two-dimensional projection of the three dimensional space within which the motive mechanism is designed operate; for instance, where the plane containing the knife 202 is known to the computing device 207, such as when the orientation of the edge of the knife 202 is vertically over or under the spine of the knife, the computing device 207 may map the image to the plane containing the knife 202. The computing device may determine the location of the edge of the knife 202 using the mapping. The computing device may maintain in its memory the position of the first abrader 204 so that the computing device 207 may determine a path between the first abrader 204 and the detected edge of the knife 202.

The method includes receiving, by the computing device, from an edge sensor connected to the computing device, an indication that the first abrader is in contact with the edge of the knife (302). In some embodiments, where the edge sensor 203 is a contact sensor, the edge sensor 203 sends the indication upon contacting the edge of the knife. Where the contact sensor is incorporated in the first abrader 204, as in the current sensor arrangement described above in reference to FIGS. 2A-2G, contact between the first abrader 204 and the edge of the knife may cause the signal to be sent to the computing device 207. In other embodiments, where the edge sensor 203 is a camera, the camera captures an image of the at least one abrader 204 in contact with the edge of the knife 202; the computing device 207 may detect the edge using edge-detection algorithms as described above in reference to FIG. 3.

The method 300 includes directing, by the computing device, the motive mechanism to cause the first abrader to traverse the edge of the knife (303). In some embodiments, the computing device obtains at least one knife shape profile comprising an edge path, and directs the motive mechanism to cause the at least one abrader to traverse the edge path of the at least one knife shape profile. The knife shape profile may be a curve in the three-dimensional space with respect to which the computing device 207 directs the motive mechanism 206. The knife shape profile may include more than one edge; for instance, where the knife 202 is known to be a style with multiple edge portions not continuously connected, such as the set of blades in a food processor, the knife shape profile may include a set of curves corresponding to each edge, located within the three-dimensional space with respect to which the computing device 207 directs the motive mechanism 206. Where the edge of the knife 202 is serrated, the computing device 207 may record the serrations as a series of small separate edges with concave curvature. The computing device may direct the abrader to follow the edge path indicated in the knife shape profile. Where there is more than one edge, the computing device 207 may treat each edge as a separate knife, and direct the abrader to follow the multiple edges seriatim. For instance, where the knife is serrated, the computing device 207 may direct the abrader to sharpen each serration as a small, curved knife-edge in its own right.

In some embodiments, the computing device 207 maintains a set of knife shape profiles in memory coupled to the computing device 207. The computing device may match the knife 202 to a stored profile using input received from a sensor; for instance, a camera connected to the computing device 207 may capture an image of the knife 202, and the computing device 207 may compare that image to knife shape profiles stored within memory coupled to the computing device 207 and select a profile matching the image. In other embodiments, the computing device obtains the knife shape profile by capturing, with a camera coupled to the computing device, an image of the knife 202, and detecting, using an edge detection algorithm, the edge of the knife. The edge detection algorithm may be a search-based edge detection algorithm. The edge detection algorithm may be a zero-crossing edge detection algorithm.

In some embodiments, the computing device 207 determines the edge path of the knife by directing a contact sensor to traverse the edge of the knife, receiving edge location information from the contact sensor responsive to the traversal, and determining, responsive to the location information, the edge path. For instance, where the edge sensor 203 is a linear displacement sensor placed to contact the edge of the knife such that changes in the path of the edge of the knife cause changes in the linear displacement, the computing device 207 may direct the motive mechanism 206 to cause the linear displacement sensor to traverse the edge of the knife; the computing device 207 may then combine the displacement data from the sensor with the traversal path the computing device 207 sent to the motive mechanism 206 to determine the knife shape profile.

Some embodiments further involve determining that the edge path does not follow the edge of the knife, correcting the edge path to follow the edge of the knife, and maintaining, in memory accessible to the computing device, the corrected edge path. Determining may involve receiving an indication of a change in direction from a sensor, as set forth in more detail below. Determining may involve receiving an indication that the first abrader 204 has lost contact with the edge, as set forth in more detail below. The computing device 207 may plot a point on the corrected path using the determination; in some embodiments, the computing device 207 performs a plurality of determinations to plot a plurality of points on the corrected path. The computing device may create the corrected path by interpolating between plotted points on the corrected path; for instance, the computing device may draw a best curve through the plotted corrected path points. The computing device may develop the interpolated curve using a computational method such as cubic spline interpolation.

In some embodiments, the computing device 207 directs the first abrader 204 by receiving, from the edge sensor 203, an indication that the first abrader 204 is no longer in contact with the edge of the knife 202, directing the motive mechanism to move the edge of the knife 202 and the first abrader 204 towards each other, receiving, from the edge sensor, an indication that the first abrader 204 is in contact with the edge of the knife 202, and directing the motive mechanism to stop moving the edge of the knife 202 and first abrader 204 towards each other. In another embodiment, the computing device directs the first abrader 204 by receiving, from a contact edge sensor preceding the first abrader along the edge, an indication of a change in direction of the edge, and directing the first abrader to change direction in response to the received indication. Receiving the indication of the change in direction may involve receiving an indication that the contact sensor has lost contact with the edge. In some embodiments, the computing device directs the contact sensor to move in a different direction until the contact sensor contacts the edge again; the computing device 207 may determine the path as modified by the change in direction using any method as described above for computing a corrected path. In some embodiments, where the contact sensor is a linear displacement sensor, the contact sensor may send to the computing device 207 a degree of displacement; for instance, the linear displacement sensor may be oriented as described above for detecting the knife shape profile, permitting the computing device 207 to determine the change in direction using displacement data from the linear displacement sensor. In some embodiments, a second contact sensor follows the first abrader 204 to aid in determining the path the abrader should follow.

In some embodiments, the computing device 207 determines a sharpening angle of the knife 202 and directs the knife sharpener 200 to adjust the angle of the first abrader 204 with respect to the knife 202 to match the determined sharpening angle. In some embodiments the computing device determines the sharpening angle by directing a camera to pan past the edge of the knife while maintaining the edge in its field of vision, and determining a viewing angle at which the specular reflection of light off of the plane of the sharpening angle is maximal. The specular reflection may be from a natural light source. The specular reflection may be from a light source attached to the camera lens. The camera lens may rotate as it moves past the edge so that it is always facing the edge. In other embodiments, the computing device determines the sharpening angle by directing a displacement sensor to traverse the knife from its spine to its edge, and measuring the change in displacement during the traversal. For instance, the degree of displacement of the linear displacement sensor per centimeter of traversal from the spine to the edge of the knife may inform the computing device of the slope of the bevel to the edge of the knife, from which the computing device can determine the sharpening angle. The computing device 207 may direct a linear displacement to perform this traversal on both sides of the knife, to determine the sharpening angle on either side of the edge. The computing device 207 may modify the angle of the first abrader 204 with respect to the knife 202 by changing the angle of the first abrader 204 as indicated above in reference to FIGS. 2A-2G. The computing device 207 may modify the angle of the first abrader 204 with respect to the knife 202 by modifying the angle of the knife 202 as set forth above in reference to FIGS. 2A-2G.

In some embodiments, the computing device determines a grind style of the knife and directs the first abrader to grind the knife based on the determination. The computing device 207 may determine the grind style of the knife by causing a camera to pan past the edge of the knife 202 as set forth above in reference to FIG. 3. The computing device 207 may direct one or more contact sensors to traverse the knife as indicated above in reference to FIG. 3. Thus, for instance, if the displacement per centimeter of motion toward the edge, as recorded by a linear displacement sensor, indicates a convex path, the computing device 207 may determine that the knife 202 has a convex grind. If the displacement per centimeter of motion indicates a concave path, the computing device 207 may determine that the knife 202 is hollow-ground. If the displacement proceeds linearly one side and is absent on the other, the computing device 202 may determine that the knife has a chisel grind. If the displacement proceeds linearly on both sides, the computing device 207 may determine that the knife 202 has a saber grind, or a flat grind. In some embodiments, the computing device 207 selects the first abrader 204 from a plurality of abraders, based on the determination. For instance, where the knife 202 is hollow-ground, the computing device 207 may select a wheel with an appropriately small circumference as the first abrader 204. Where the knife-edge is serrated, the computing device 207 may select as the first abrader 204 a wheel with a curved edge that can fit within the serrations. Where the grind requires sharpening from both sides of the knife 202, for instance if the knife is saber-ground, the computing device 207 may direct one or more abraders to sharpen from both sides of the knife. Where the grind requires sharpening from only one side of the knife 202, for instance, where the knife 202 is chisel-ground, the computing device 207 may direct one or more abraders to sharpen only one side of the knife 202; the computing device 207 may direct a fine abrader to polish the non-ground side of the knife 202 to reduce the burr below a threshold degree of fineness. In some embodiments the threshold is a measurement in micrometers. In other embodiments, the threshold is a degree of fineness that renders the burr undetectable to the sensor used to detect the burr.

In some embodiments, the computing device 207 detects a portion of the edge of the knife 202 that lacks a burr and directs the motive mechanism 206 to cause the first abrader 204 to traverse the detected section of the edge of the knife. In some embodiments, the computing device 207 detects the presence or absence of burr on the edge of the knife by taking a first picture of the edge with a camera prior to sharpening, taking a second picture of the edge with the camera after sharpening, and comparing the first picture to the second picture. A portion of the edge in the second picture that is unchanged from the first picture may indicate a lack of burr. The camera may be positioned such that its lens is parallel to the bevel of the knife 202. A light source may be used to increase the visibility of the burr. In other embodiments, the computing device 207 detects the presence or absence of burr by comparing the signal from sensor, such as an inductive metal proximity sensor or a laser profile sensor, at a particular point on the edge after sharpening to a similar input taken prior to sharpening: where the input is the same, the computing device 207 may determine an absence of burr.

In some embodiments, the computing device directs a series of two or more abraders to sharpen the knife 202. For instance, in one embodiment, for each of one or more additional abraders, the computing device directs the motive mechanism to bring the additional abrader and the edge of the knife into contact receives, from an edge sensor connected to the computing device, an indication that the additional abrader is in contact with the edge of the knife, and directs the motive mechanism to cause the additional abrader to traverse the edge of the knife. In some embodiments, where the first abrader 204 is positioned only to abrade one side of the edge of the knife 204, an additional abrader may be an abrader positioned to abrade the other side of the edge of the knife 204, as depicted in FIGS. 2C and 2E; for instance, at least one additional abrader may include a coarse abrader to grind the second bevel of a saber-ground knife. In other embodiments, the additional abrader is a fine abrader as disclosed above in reference to FIGS. 2A-2G; coarse abraders, as depicted in FIGS. 2C and 2E may be followed by fine abraders, as depicted in FIGS. 2D and 2F, for instance. The additional abrader may be a honing abrader, as described above in reference to FIGS. 2A-2G. The additional abrader may be a stropping abrader as described above in reference to FIGS. 2A-2G. In some embodiments, where the first abrader and the additional abrader are sharpening discs, the additional abrader may rotate in the opposite direction from the first abrader; alternatively, the additional abrader may rotate in the same direction but be angled differently with respect to a line tangent to the edge, to achieve the same effect as a reversal.

In some embodiments, the computing device 207 determines a degree of wear of the edge of the knife 202 and selects the first abrader 204 from a plurality of abraders, based upon the determination. In one embodiment, the computing device 207 determines the degree of wear on the edge of the knife by sensing the width of the edge of the knife 202; for instance, the computing device may use a profile sensor as described above in reference to FIGS. 2A-2G to measure the width of the edge from an orientation directly facing the edge. A greater sensed edge width may indicate an edge that requires a greater degree of sharpening. The computing device 207 may determine the degree of wear by capturing, using a camera oriented to face the edge of the knife 202, an image of the edge of the knife 202 and identifying a degree of wear in the captured image. For instance, the computing device may measure the intensity of light reflected back at the camera at a given spot on the edge. If the light reflected back is very intense, it may indicate a large flat or rolled spot requiring a coarse grinding. If the light is moderately intense, it may indicate the need for a honing or light grinding procedure. If the light is very weak, it may indicate that the edge needs very little sharpening, indicating, for instance, that the edge should be stropped. In some embodiments, where a sensor is able to indicate to the computing device 207 that a knife is being inserted or removed, the computing device 207 may determine that the knife 202 has not been removed since the last sharpening, and thus that no sharpening is necessary at all; for instance, a camera can indicate to the computing device 207 that the knife is being removed or inserted, or confirm that the knife 202 remains in place. Likewise, any profile or proximity sensor described above may indicate whether the knife 202 remains in the holder. The knife sharpener 200 may also include an emitter-receiver sensor, for instance, whose beam will be interrupted while a knife is in the holder, and may thus enable the sensor to indicate the presence or absence of the knife, and thus enable to computing device 207 to determine whether the knife 202 has been removed since the last sharpening.

In another embodiment, the computing device 207 maintains, in memory accessible to the computing device 207, a sharpening schedule for at least one knife, determines that the knife 202 matches the at least one knife in the sharpening schedule, and retrieves from the sharpening schedule an expected degree of wear for the knife. Matching the knife 202 to the at least one knife 202 in the schedule may involve using any method described above in reference to FIG. 3 for determining the profile of the knife 202. As an example, if the knife 202 is a razor, proper maintenance may involve stropping after every use; in some embodiments, a sharpening schedule for a razor may call for stropping on a daily basis. In other embodiments, the sharpening schedule for the razor may call for stropping on each detected insertion. Another knife 202, such as a kitchen knife, may require daily honing to maintain a biting edge, and monthly grinding; the sharpening schedule for the kitchen knife may thus call for daily honing with a fine or honing abrader 204 and monthly grinding with a coarser abrader 204. Still other embodiments may combine a sharpening schedule with wear detection as described above. As an example, a razor may be stropped on each insertion, but also checked for signs of wear indicating that it must be reground; upon detection of those signs of wear, the computing device 207 may select an abrader 204 suitable to impart a renewed hollow grind to the razor blade.

In some embodiments, the computing device 207 directs a vacuum to clean up filings created by the sharpening process. In other embodiments, the computing device 207 directs an electromagnet to clean up the filings created by the sharpening process. The computing device 207 may monitor the temperature of the knife using a thermometer as described above in reference to FIGS. 2A-2G. In other embodiments, the computing device monitors the temperature of the knife sharpener 200 using the thermometer as described above in reference to FIGS. 2A-2G. The computer may respond to a temperature above a certain threshold by acting to cool off the knife 202 or sharpener 200. For instance, the computing device 207 may cease sharpening until the temperature falls below a second threshold. The computing device 207 may activate a heat compensation system as described above in reference to FIGS. 2A-2G. In other embodiments, the computing device detects a degree of vibration above a threshold, using a vibration sensor as described above in reference to FIGS. 2A-2G. The computing device 207 may respond to reduce vibration. The computing device 207 may pause sharpening to allow the vibration to decrease below a second threshold level. The computing device 207 may activate vibration compensation devices as disclosed above in reference to FIGS. 2A-2G.

It will be understood that the system and method may be embodied in other specific forms without departing from the spirit or central characteristics thereof. The present examples and embodiments, therefore, are to be considered in all respects as illustrative and not restrictive, and the system method is not to be limited to the details given herein.

What is claimed is:

1. A knife sharpener, comprising:

a knife holder in which a knife is inserted so that an edge of the knife is exposed;

at least one sensor, configured to detect the edge of the knife and to detect a burr on the edge of the knife;

at least one abrader, the at least one abrader having a sharpening surface angled to meet an edge of the knife at a sharpening angle of one side of the knife;

a motive mechanism connected to the holder and the at least one abrader; and a computing device in communication with the edge sensor and the motive mechanism, and configured to cause the at least one abrader to traverse the edge of the knife using the motive mechanism, in response to the at least one sensor, to detect a burr on the edge of the knife, using the at least one sensor, determine that a portion of the edge of the knife does not have a burr, and to cause the at least one abrader to traverse the portion of the edge of the knife that does not have a burr.

2. A knife sharpener according to claim 1, wherein the at least one sensor further comprises a power source in electrical contact with the knife and with the at least one sharpening abrader, the power source further connected to a current sensor, such that contact between the knife and the at least one abrader modifies current flow through the current sensor.

3. A knife sharpener according to claim 1, wherein the at least one sensor further comprises a camera.

4. A knife sharpener according to claim 1, wherein the at least one abrader further comprises at least one coarse abrader and at least one fine abrader.

5. A method for sharpening a knife positioned in a holder of a knife sharpener according to claim 1 with an edge of the knife exposed, the method performed by a computing device incorporated in the knife sharpener, the method comprising:

activating, by the computing device, the motive mechanism to bring a first abrader, of the at least one abrader, and the knife toward each other;

receiving, by the computing device, from at least one sensor connected to the computing device, an indication that the first abrader is in contact with the edge of the knife; and directing, by the computing device, the motive mechanism to cause the first abrader to traverse the edge of the knife;

detecting, by the computing device, a burr on the edge of the knife, using the at least one sensor;

determining, by the computing device, based on the detection, that a portion of the edge of the knife does not have a burr; and directing, by the computing device, the motive mechanism to cause the first abrader to traverse the portion of the edge of the knife that does not have a burr.

6. A method according to claim 5, wherein activating further comprises:

maintaining in memory accessible to the computing device a known orientation of the knife;

maintaining in memory accessible to the computing device a known orientation of the first abrader; and directing the motive mechanism to move the first abrader and knife toward one another along a path between the knife and the first abrader.

7. A method according to claim 5, wherein directing the motive mechanism to cause the first abrader to traverse the edge of the knife further comprises:

obtaining, by the computing device, at least one knife shape profile comprising an edge path; and directing the motive mechanism to cause the at least one abrader to traverse the edge path of the at least one knife shape profile.

8. A method according to claim 7, wherein obtaining further comprises:

capturing, with a sensor coupled to the computing device, an image of the knife; and detecting, using an edge detection algorithm, the edge of the knife.

9. A method according to claim 7, wherein obtaining further comprises:

directing a contact sensor to traverse the edge of the knife;

receiving edge location information from the contact sensor responsive to the traversal; and determining, responsive to the location information, the edge path.

10. A method according to claim 7, further comprising:

determining that the edge path does not follow the edge of the knife;

correcting the edge path to follow the edge of the knife; and maintaining in memory accessible to the computing device, the corrected edge path.

11. A method according to claim 5, wherein directing the motive mechanism to cause the first abrader to traverse the edge of the knife further comprises:

receiving, from the edge sensor, an indication that the first abrader is no longer in contact with the edge of the knife;

directing the motive mechanism to move the edge of the knife and the first abrader towards each other;

receiving, from the edge sensor, an indication that the first abrader is in contact with the edge of the knife; and directing the motive mechanism to stop moving the edge of the knife and first abrader towards each other.

12. A method according to claim 5, wherein directing the motive mechanism to cause the first abrader to traverse the edge of the knife further comprises:

receiving, from a contact edge sensor preceding the first abrader along the edge, an indication of a change in direction of the edge; and directing, by the computing device, the first abrader to change direction in response to the received indication.

13. A method according to claim 5, wherein directing the motive mechanism to cause the first abrader to traverse the edge of the knife further comprises:

determining, by the computing device, a sharpening angle of the knife; and directing, by the computing device, the knife sharpener to adjust the angle of the first abrader with respect to the knife to match the determined sharpening angle.

14. A method according to claim 5, further comprising:

determining, by the computing device, a grind style of the knife; and directing, by the computing device, the first abrader to grind the knife based on the determination.

15. A method according to claim 14, further comprising selecting, by the computing device, the first abrader from a plurality of abraders, based on the determination.

16. A method according to claim 5, further comprising, for each of one or more additional abraders:

directing, by the computing device, the motive mechanism to bring the additional abrader and the edge of the knife into contact;

receiving, by the computing device, from sensor connected to the computing device, an indication that the additional abrader is in contact with the edge of the knife; and directing, by the computing device, the motive mechanism to cause the additional abrader to traverse the edge of the knife.

17. A method for sharpening a knife positioned in a holder of a knife sharpener with an edge of the knife exposed, the method performed by a computing device incorporated in the knife sharpener, the method comprising:

determining, by the computing device, using at least one sensor incorporated in the knife sharpener, the width of the edge of the knife;

determining, by the computing device, a degree of wear of the edge of the knife, using the determined width of the edge of the knife;

selecting, by the computing device, an abrader from a plurality of abraders incorporated in the knife sharpener, based upon the determination;

activating, by the computing device, a motive mechanism incorporated in the knife sharpener to bring the selected abrader and the knife toward each other;

receiving, by the computing device, from the at least one sensor, an indication that the selected abrader is in contact with the edge of the knife; and directing, by the computing device, the motive mechanism to cause the selected abrader to traverse the edge of the knife.

18. A method for sharpening a knife positioned in a holder of a knife sharpener with an edge of the knife exposed, the method performed by a computing device incorporated in the knife sharpener, the method comprising:

maintaining, in memory accessible to the computing device, a sharpening schedule for at least one knife;

determining that the knife matches the at least one knife in the sharpening schedule;

retrieving from the sharpening schedule an expected degree of wear for the knife;

selecting, by the computing device, an abrader from a plurality of abraders incorporated in the knife sharpener, based upon the expected degree of wear;

activating, by the computing device, a motive mechanism incorporated in the knife sharpener to bring the selected abrader and the knife toward each other;

receiving, by the computing device, from the at least one sensor, an indication that the selected abrader is in contact with the edge of the knife; and directing, by the computing device, the motive mechanism to cause the selected abrader to traverse the edge of the knife.

* * * * *